US009240303B2

(12) United States Patent
Barnum et al.

(10) Patent No.: US 9,240,303 B2
(45) Date of Patent: Jan. 19, 2016

(54) DUAL TUBE SUPPORT FOR ELECTRON EMITTER

(71) Applicant: Moxtek, Inc., Orem, UT (US)

(72) Inventors: Brian Barnum, Alpine, UT (US); Dustin Peterson, Spanish Fork, UT (US); Eric Miller, Provo, UT (US); Eric Draper, Santaquin, UT (US); Jon Barron, Lehi, UT (US)

(73) Assignee: Moxtek, Inc., Orem, UT (US)

( * ) Notice: Subject to any disclaimer, the term of this patent is extended or adjusted under 35 U.S.C. 154(b) by 86 days.

(21) Appl. No.: 14/325,896

(22) Filed: Jul. 8, 2014

(65) Prior Publication Data

US 2015/0071410 A1 Mar. 12, 2015

Related U.S. Application Data

(60) Provisional application No. 61/876,036, filed on Sep. 10, 2013.

(51) Int. Cl.

| | |
|---|---|
| ***H01J 35/06*** | (2006.01) |
| ***H01J 9/26*** | (2006.01) |
| ***H01J 9/385*** | (2006.01) |
| *H01J 35/16* | (2006.01) |
| *H01J 35/00* | (2006.01) |

(52) U.S. Cl.

CPC . *H01J 35/06* (2013.01); *H01J 9/26* (2013.01); *H01J 9/385* (2013.01); *H01J 35/00* (2013.01); *H01J 35/16* (2013.01)

(58) Field of Classification Search

CPC ..... H01J 9/26; H01J 9/385; H01J 35/00; H01J 35/02; H01J 35/04; H01J 35/06; H01J 35/08; H01J 35/16; H01J 2235/087; H01J 2235/02; H01J 2235/06; H01G 1/04

See application file for complete search history.

(56) References Cited

U.S. PATENT DOCUMENTS

| | | | | |
|---|---|---|---|---|
| 5,414,267 | A | 5/1995 | Wakalopulos | |
| 6,044,130 | A | 3/2000 | Inazura et al. | |
| 6,438,206 | B1 * | 8/2002 | Shinar | A61N 5/1001 378/119 |
| 7,236,568 | B2 * | 6/2007 | Dinsmore | H01J 35/065 378/119 |
| 2007/0211862 | A1 | 9/2007 | Ito et al. | |
| 2009/0010393 | A1 | 1/2009 | Klinkowstein et al. | |
| 2012/0207279 | A1 | 8/2012 | Shimono | |

OTHER PUBLICATIONS

PCT Application No. PCT/US14/45987: Filing date Jul. 9, 2014; Moxtek, Inc.; International Search Report mailed Nov. 18, 2014.

* cited by examiner

*Primary Examiner* — Glen Kao
*Assistant Examiner* — Julio M Duarte-Carvajalino
(74) *Attorney, Agent, or Firm* — Thorpe, North & Western, LLP

(57) ABSTRACT

An x-ray tube including dual, electrically-conductive emitter tubes to support and provide electrical power to an electron emitter. A method of evacuating and sealing the x-ray tube by drawing a vacuum on the x-ray tube through an inner tube of dual emitter tubes, then pinching the inner tube to seal off the enclosure and to maintain a vacuum therein.

20 Claims, 7 Drawing Sheets

DUAL TUBE SUPPORT FOR ELECTRON EMITTER

CLAIM OF PRIORITY

This claims priority to U.S. Provisional Patent Application No. 61/876,036, filed on Sep. 10, 2013, which is hereby incorporated herein by reference in its entirety.

FIELD OF THE INVENTION

The present application is related generally to electron emitters in x-ray tubes.

BACKGROUND

A critical component of x-ray tubes is the electron emitter, such as a filament for example. A solid support for the electron emitter can be important because motion of such support can cause the electron emitter to bend or distort. Bending or distortion of the electron emitter during use can result in early electron emitter failure, which can cause the x-ray tube to fail. The cost of the electron emitter support, both material and manufacturing cost, can be important for a low x-ray tube cost. Precise and repeatable placement of the electron emitter in the x-ray tube during manufacturing can be important to ensure consistency of x-ray output between different units of a single x-ray tube model. Long x-ray tube life also can be important.

SUMMARY

It has been recognized that it would be advantageous to have an x-ray tube with a sturdy, low cost electron emitter support that can be placed precisely and repeatedly in the correct location in manufactured x-ray tubes. It has been recognized that long x-ray tube life can be important. The present invention is directed to various embodiments of x-ray tubes with electron emitter supports that satisfy these needs. Each embodiment may satisfy one, some, or all of these needs. The present invention is also directed to a method of evacuating and sealing an x-ray tube that satisfies one, some, or all of these needs.

The x-ray tube comprises an evacuated, electrically-insulative enclosure with a cathode and an anode at opposite ends thereof. Dual, electrically-conductive emitter tubes can extend from the cathode towards the anode. The emitter tubes can comprise an inner tube and an outer tube with the inner tube disposed at least partially within the outer tube. The inner and outer tubes can have opposite ends comprising a near end associated with the cathode and a far end disposed closer to the anode. There can be a first gap between the far end of the outer tube and the anode and a second gap between the far end of the inner tube and the anode. An electron emitter can be coupled between the far end of the inner tube and the far end of the outer tube. The inner and outer tubes can be electrically isolated from one another except for the electron emitter.

The method, of evacuating and sealing an x-ray tube, can comprise some or all of the following steps:

1. providing the x-ray tube with:
   i. a cathode and an anode at opposite ends of an electrically-insulative enclosure;
   ii. dual, electrically-conductive emitter tubes extending from the cathode towards the anode, and comprising an inner tube disposed at least partially within an outer tube;
   iii. each of the inner and outer tubes having opposite ends comprising a near end associated with the cathode and a far end disposed closer to the anode;
   iv. an electron emitter coupled between the far end of the inner tube and the far end of the outer tube;
   v. the inner and outer tubes being electrically isolated from one another except for the electron emitter;
   vi. the inner tube being open with the near end of the inner tube extending outside the enclosure beyond the cathode; and
   vii. the enclosure sealed off except for the open inner tube;
2. substantially evacuating the x-ray tube by drawing a vacuum on the enclosure through the open inner tube; and
3. sealing off the substantially evacuated x-ray tube by pinching shut the near end of the inner tube.

DEFINITIONS

As used herein, the term "concentric", in relation to the concentric emitter tubes 14, means that the inner tube $\mathbf{14}_i$ is substantially centered in the outer tube $\mathbf{14}_o$.

As used herein, "evacuated" or "substantially evacuated" means a vacuum such as is typically used for x-ray tubes.

DETAILED DESCRIPTION

Figure 1:
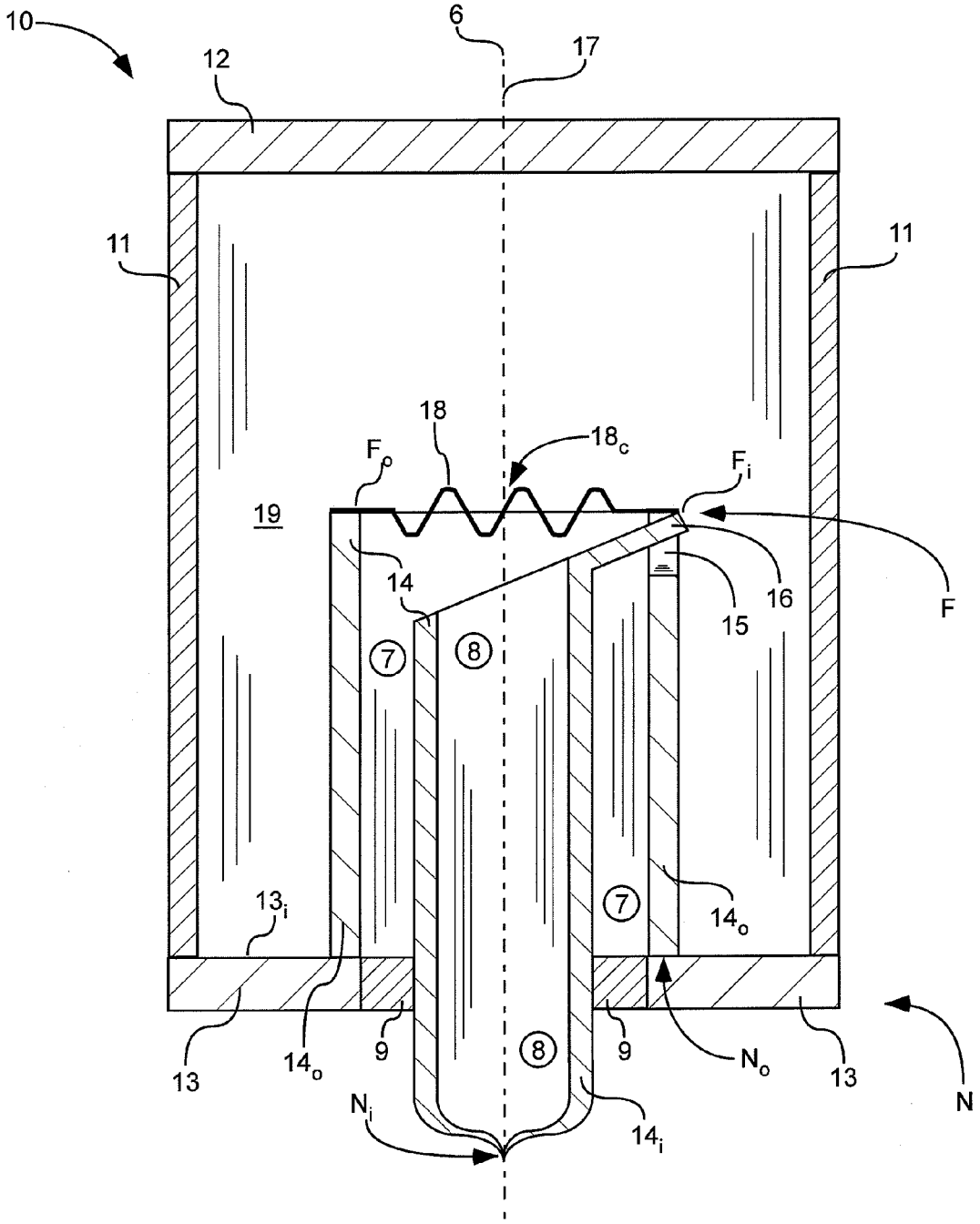
FIGS. 1-2 are schematic, longitudinal, cross-sectional side views of an x-ray tube including dual, electrically-conductive emitter tubes as an electron emitter support, in accordance with an embodiment of the present invention.
Figure 2:
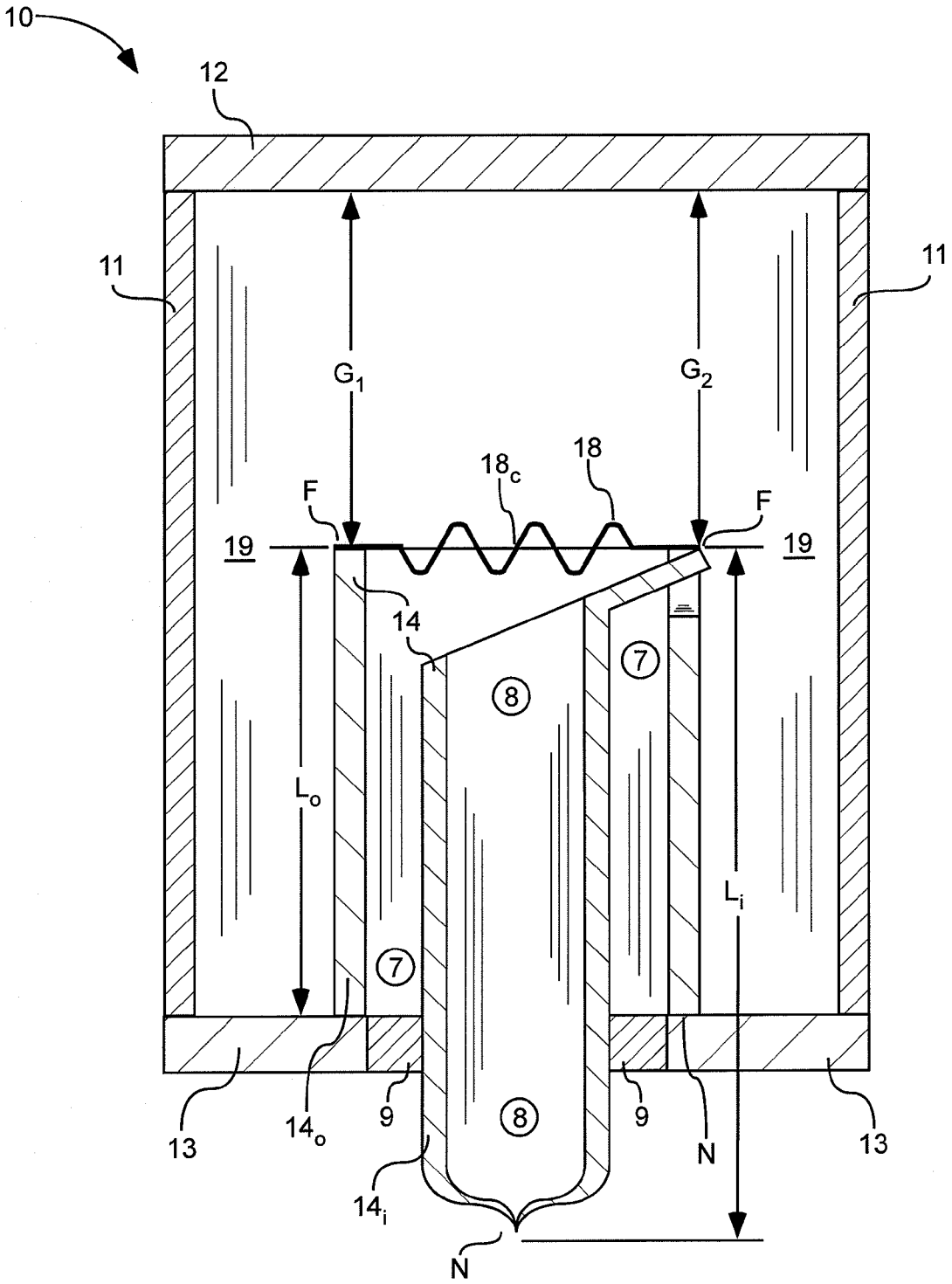
Figure 3:
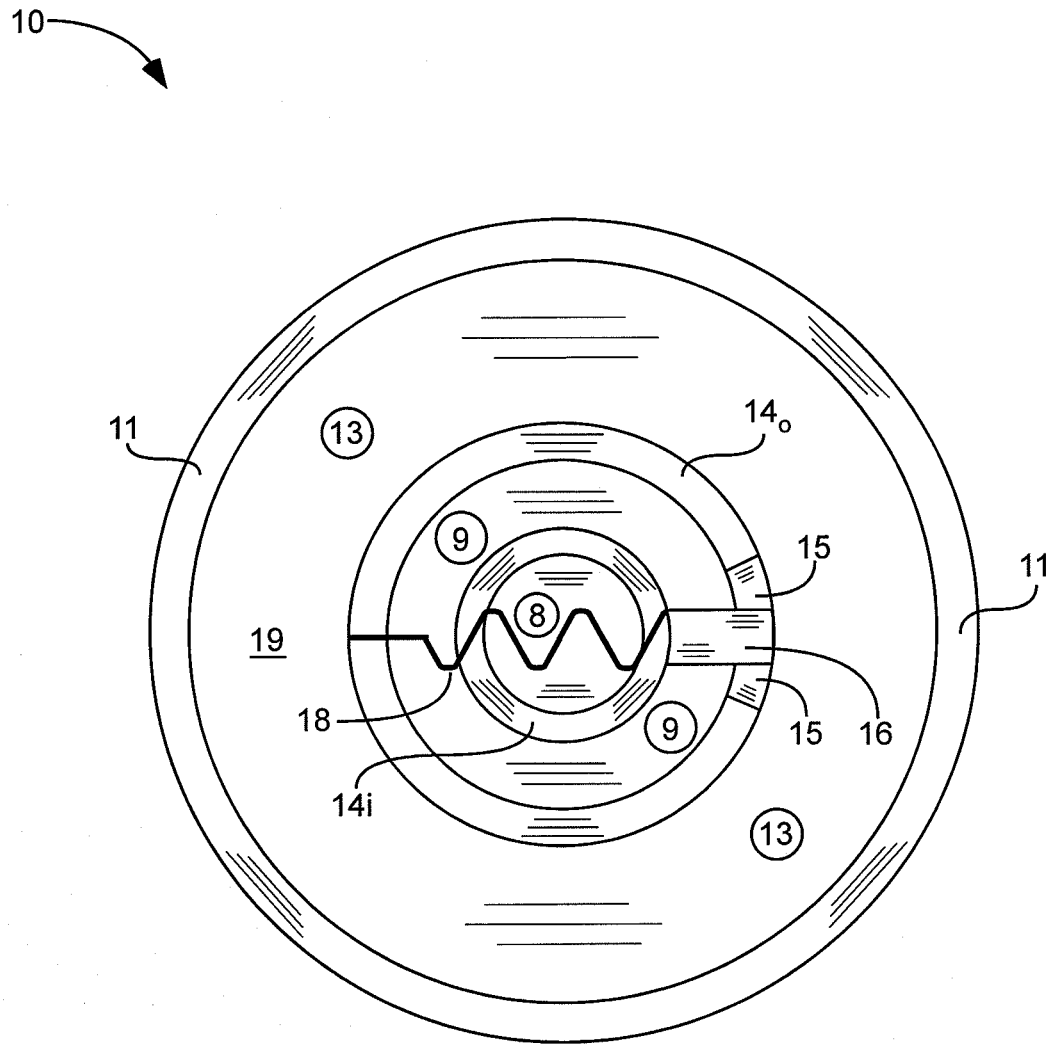
FIG. 3 is a schematic, lateral, cross-sectional side view of an x-ray tube including dual, electrically-conductive emitter tubes as an electron emitter support (this lateral side view is orthogonal to the longitudinal side views of FIGS. 1-2), in accordance with an embodiment of the present invention.

As illustrated in FIGS. 1-3, an x-ray tube 10 is shown comprising an evacuated, electrically-insulative enclosure 11 with a cathode 13 and an anode 12 at opposite ends thereof. The enclosure 11 can be or can comprise a ceramic material. Dual, electrically-conductive emitter tubes 14 can extend from the cathode 13 towards the anode 12, and can comprise an inner tube $\mathbf{14}_i$ and an outer tube $\mathbf{14}_o$. The inner tube $\mathbf{14}_i$ can be disposed at least partially inside of the outer tube $\mathbf{14}_o$.

The inner tube $\mathbf{14}_i$ and the outer tube $\mathbf{14}_o$ can have or share a common central region 8. The inner tube $\mathbf{14}_i$ and the outer tube $\mathbf{14}_o$ can be concentric. The inner tube $\mathbf{14}_i$ and the outer tube $\mathbf{14}_o$ can have a common longitudinal axis 17. Alternatively, there can be some offset between a longitudinal axis 17 of the inner tube $14_i$ with respect to a longitudinal axis 17 of the outer tube $14_o$. It can be beneficial to align the longitudinal axis 17 of both of the emitter tubes 14 with each other to allow sufficient gap 7 between the inner tube $14_i$ and the outer tube $14_o$ for voltage isolation (to force electrical current to flow through the filament 18 rather than from direct contact between the inner tube $14_i$ and the outer tube $14_o$). For some designs, some misalignment of the longitudinal axis 17 of the inner tube $14_i$ with respect to the longitudinal axis 17 of the outer tube $14_o$ may be preferred, such as for example for manufacturability considerations.

The longitudinal axis 17 of the emitter tubes 14 can be substantially aligned with a longitudinal axis 6 of the enclosure 11. Alternatively, there can be some offset between a longitudinal axis 17 of the emitter tubes 14 and a longitudinal axis 6 of the enclosure 11. It can be beneficial to align the longitudinal axis 17 of both of the emitter tubes 14 with a longitudinal axis 6 of the enclosure 11 if x-ray emission from anode 12 center is desired.

Each of the inner 14, and outer $14_o$ tubes can have opposite ends (N and F) comprising a near end N associated with, disposed adjacent to, or attached to the cathode 13 and a far end F disposed closer to the anode 12. An electron emitter 18 can be coupled between a far end $F_i$ of the inner tube $14_i$ and a far end $F_o$ of the outer tube $14_o$. The inner $14_i$ and outer $14_o$ tubes can be electrically isolated from one another except for the electron emitter 18. For example, an electrically insulative material 9 can be disposed near or attached to the cathode 13 and can, along with the gap 7 (possibly a vacuum-filled gap), electrically insulate the inner tube $14_i$ from the outer tube $14_o$. This electrically insulative material 9 can be an electrically insulative spacer ring and can partially fill a gap between the inner tube $14_i$ and the outer tube $14_o$ and can hold the inner tube $14_i$ in proper position with respect to the outer tube $14_o$.

The electron emitter 18 can be a filament. The filament can be various types or shapes including helical or planar.

The far end $F_i$ of the inner tube $14_i$ can include a radial projection 16 extending radially outwardly from the inner tube $14_i$ towards the outer tube $14_o$. The radial projection 16 can extend towards a groove 15 in the far end $F_o$ of the outer tube $14_o$. Use of the radial projection 16 can allow the electron emitter 18 to be substantially centered across the far end $F_o$ of the outer tube $14_o$. A center $18_c$ of the electron emitter 18 can be substantially aligned with a longitudinal axis 6 of the enclosure 11, which can result in x-ray emission from a center of a transmission window on the anode 12.

The far end $F_o$ of the outer tube $14_o$ can substantially surround a circumference of the far end $F_i$ of the inner tube $14_i$ with the exception of the groove 15. This design can smooth out electric field gradients around the electron emitter 18 and the far end F of the emitter tubes 14.

A length $L_i$ of the inner tube $14_i$ can be greater than a length $L_o$ of the outer tube $14_o$. In one embodiment, the near end $N_o$ of the outer tube $14_o$ can terminate within the enclosure 11 and can contact an inner surface $13_i$ of the cathode 13. The near end $N_i$ of the inner tube $14_i$ can extend through the cathode 13 outside the enclosure 11.

Figure 5:
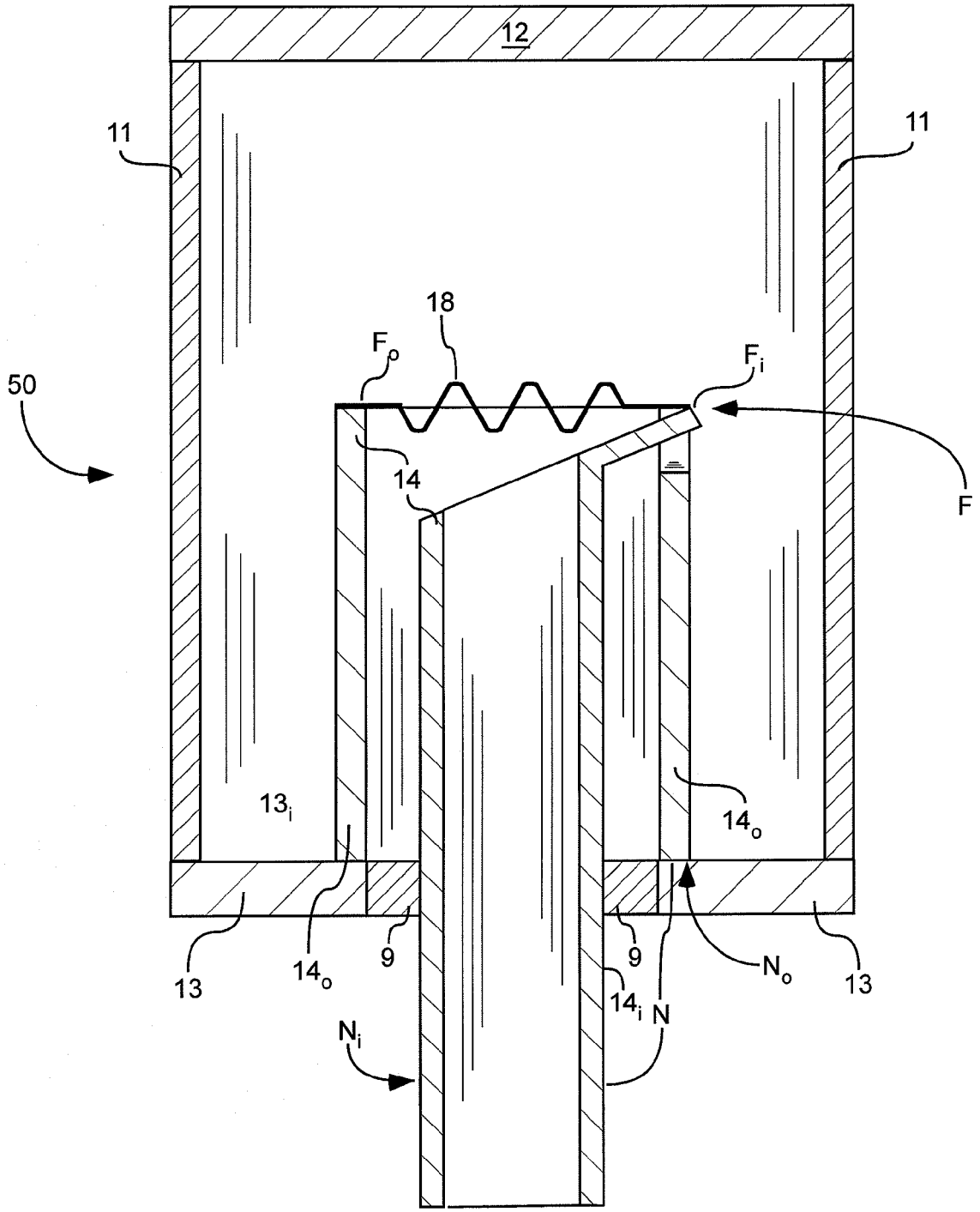
FIG. 5 is a schematic, longitudinal, cross-sectional side view of an x-ray tube including an open inner tube, in accordance with an embodiment of the present invention.
Figure 6:
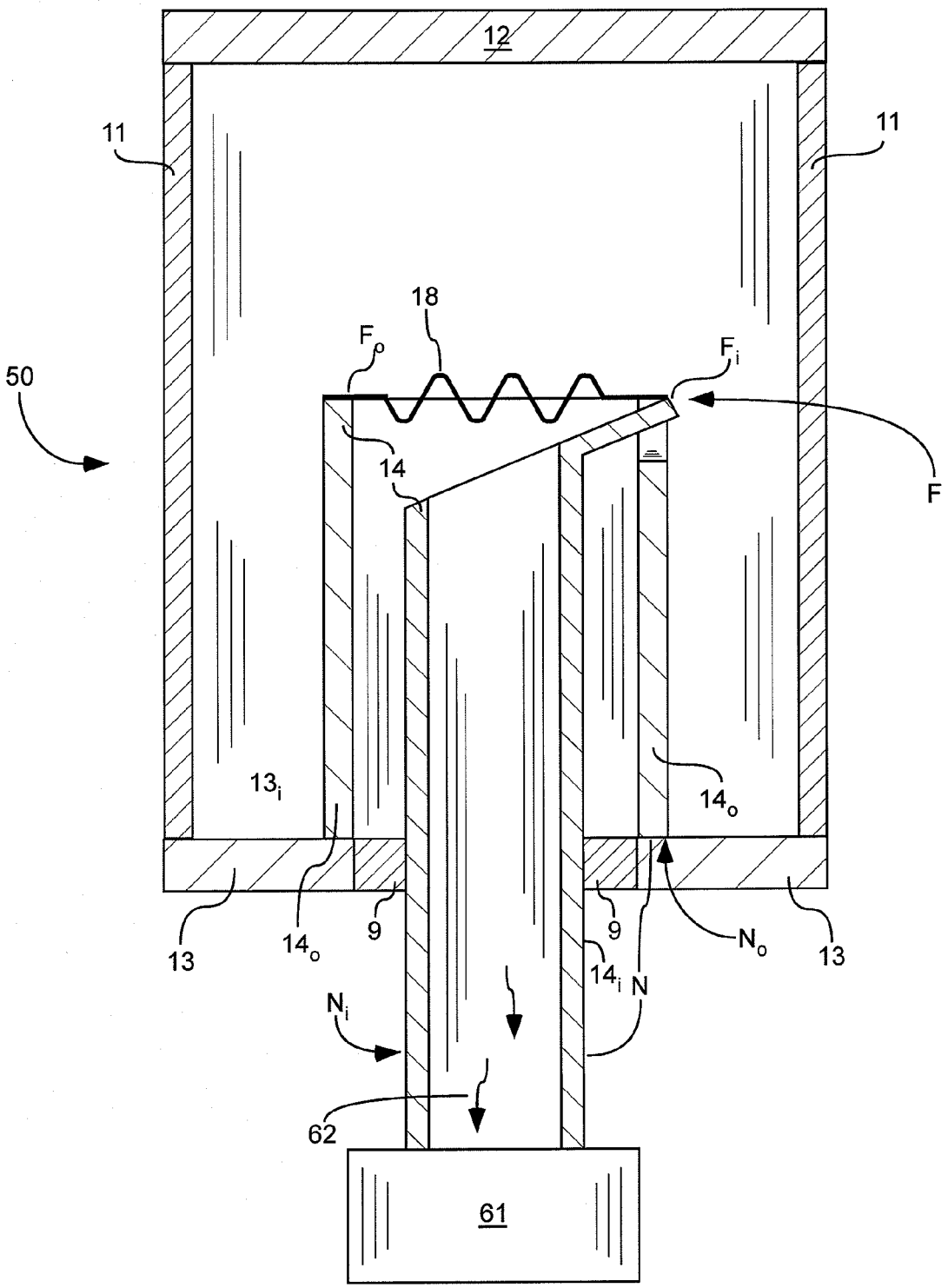
FIG. 6 is a schematic, longitudinal, cross-sectional side view of an x-ray tube including a vacuum pump attached to the open inner tube and drawing a vacuum on an interior of the x-ray tube, in accordance with an embodiment of the present invention.

The inner tube $14_i$ can initially remain open to allow the inner tube $14_i$ to be a vacuum port to draw a vacuum on the inside of the x-ray tube. See for example, open inner tube $14_i$ in FIG. 5 and vacuum pump 61 pumping out gases 62 in FIG. 6. The near end $N_i$ of the inner tube $14_i$ can then be pinched shut, such as by crimping the tube walls together. This crimping or pinching can be done with a hydraulic tool operated at high pressure, such as greater than 500 psi. See for example pinching process and a tool 71 for pinching the inner tube 14, in FIG. 7. The near end $N_i$ of the inner tube $14_i$ can then be defined as a pinched-shut end. Use of the inner tube $14_i$ to act as a vacuum port can avoid the need of using a separate component for this function, thus saving manufacturing cost.

The inner tube $14_i$ can be made of or can comprise a soft or ductile metal that can be pinched shut, such as copper or nickel for example. The outer tube $14_o$ can comprise titanium. Use of titanium can help in maintaining a vacuum inside of the enclosure 11 because titanium can absorb hydrogen. Due to the small size of the $H_2$ molecule, hydrogen can penetrate minute gaps in the x-ray tube, increase pressure therein, and cause the x-ray tube to malfunction. Thus, use of a titanium outer tube $14_o$ can be beneficial for maintaining a desired level of vacuum in the x-ray tube and thus prolong the life of the x-ray tube. It can be beneficial to use a titanium outer tube $14_o$ that has a high percent of titanium because other metals alloyed with the titanium might outgas and reduce the vacuum in the x-ray tube. For example, the outer tube $14_o$ can comprise a mass percent of at least 85% titanium in one aspect, at least 95% titanium in another aspect, at least 99% titanium in another aspect, or at least 99.8% titanium in another aspect.

There can be an annular hollow 19 between the far end $F_o$ of the outer tube $14_o$ and the enclosure 11. In other words, there can be an absence of solid material between the far end $F_o$ of the outer tube and the enclosure 11. A common feature of x-ray tube design is a cathode optic surrounding the electron emitter, to block electrons from extending radially outwards to the enclosure 11. These electrons can electrically charge the enclosure 11 and can result in early x-ray tube failure. With the x-ray tube design of the present invention, this optic can be avoided because the outer tube can substantially block electrons from extending radially outwards to the enclosure 11. By not using this cathode optic, manufacturing cost can be reduced. A cathode optic, however, may still be used with the present invention if needed for a highly focused electron beam.

There can be a first gap $G_1$ between the far end $F_o$ of the outer tube $14_o$ and the anode 12 and a second gap $G_2$ between the far end $F_i$ of the inner tube $14_i$ and the anode 12. The first gap $G_1$ can be approximately equal to the second gap $G_2$, thus keeping a plane of the electron emitter 18 substantially parallel to a face of the anode 12.

If a divergent x-ray emission is desired, it can be beneficial to dispose the electron emitter 18 near the anode 12. In addition to a divergent emission of x-rays, another benefit of disposing the electron emitter 18 closer to the anode 12 is that the electron emitter 18 can output the same power at a lower temperature, thus increasing filament life. The dual, electrically-conductive emitter tubes 14 can provide a sturdy support for the electron emitter 18, even if the electron emitter 18 extends a substantial distance from the cathode 13 towards the anode 12. In one embodiment, the first gap $G_1$ can be smaller than a length $L_o$ of the outer tube $14_o$. The first gap $G_1$ can be between 4% and 25% of a length of the outer tube $14_o$ in one embodiment or between 7% and 15% of a length of the outer tube $14_o$ in another embodiment. The electron emitter 18 can be disposed between 0.4 millimeters and 8 millimeters from the anode 12 in one embodiment or between 0.3 millimeters and 4 millimeters from the anode 12 in another embodiment.

Figure 4:
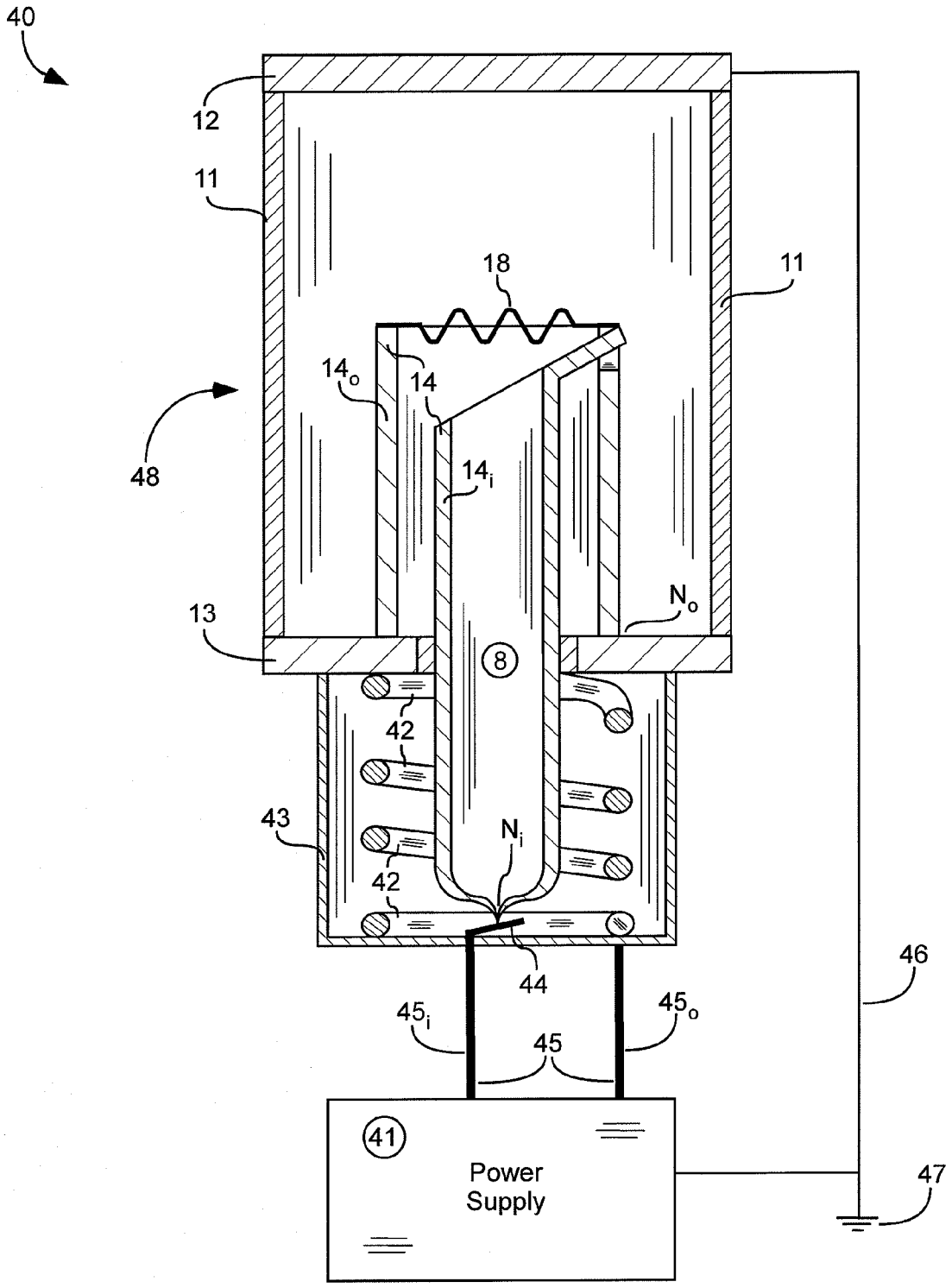
FIG. 4 is a schematic, longitudinal, cross-sectional side view of an x-ray source including an x-ray tube, similar to the x-ray tubes shown in FIGS. 1-3, and a power supply electrically connected to the x-ray tube, in accordance with an embodiment of the present invention.

As shown on x-ray source 40 in FIG. 4, a power supply 41 can provide electrical power to an x-ray tube 48. The power supply 41 can include cathode electrical connections 45 and an anode electrical connection 46. There can be a large bias voltage differential between the cathode electrical connections 45 and the anode electrical connection 46, such as many kilovolts. The cathode electrical connections 45 can have a bias voltage that is several kilovolts (perhaps tens of kilovolts) lower than the bias voltage of the an anode electrical connection 46. The anode electrical connection 46 can be electrically connected to ground 47.

The cathode electrical connections 45 can include a first cathode electrical connection $\mathbf{45}_o$ that is electrically coupled to the near end $N_o$ of the outer tube $\mathbf{14}_o$ and a second cathode electrical connection $\mathbf{45}_i$ that is electrically coupled to the near end $N_i$ of the inner tube $\mathbf{14}_i$. The power supply 41 can provide a small voltage differential, such as a few volts for example, between the first and second cathode electrical connections 45 to cause an electrical current to flow through the electron emitter 18 to heat the electron emitter 18. The heat of the electron emitter 18 and the large bias voltage between the electron emitter 18 and the anode 12 can cause electrons to emit from the electron emitter 18 towards the anode 12.

A helical spring 42 can be used to provide electrical contact between the first cathode electrical connection $\mathbf{45}_o$ and the near end $N_o$ of the outer tube $\mathbf{14}_o$. The helical spring 42 can be especially beneficial in a removable x-ray tube design because it can allow for easy electrical connection during x-ray tube insertion and removal and it can provide a large amount of electrical contact to the outer tube $\mathbf{14}_o$. The electrical contact between the helical spring 42 and the outer tube $\mathbf{14}_o$ can be through a base plate of the cathode 13 if the outer tube $\mathbf{14}_o$ terminates within the enclosure 11.

The pinched-shut near end $N_i$ of the inner tube $\mathbf{14}_i$ can be an electrical contact and can be configured to be electrically coupled to the power supply 41. The pinched-shut near end $N_i$ of the inner tube $\mathbf{14}_i$ can electrically contact the second cathode electrical connection $\mathbf{45}_i$ by various means, including by a hinge spring or a leaf spring 44. A leaf spring 44 can be convenient for providing electrical contact to the inner tube $\mathbf{14}_i$ in a removable x-ray tube design.

A plunger pin, or various other types of electrical connectors, can also be used for electrical connection between the cathode electrical connections 45 and the emitter tubes 14.

The helical spring 42 and/or the leaf spring 44 can be substantially or totally enclosed within an electrically-conductive cup 43 that is capped off with the cathode 13. This cup can act as a corona guard to shield sharp edges of the helical spring 42, the leaf spring 44, and/or the emitter tubes 14. This corona guard can help to prevent arcing between these components and surrounding or near-by components having a large voltage differential.

There are various advantages of the dual, electrically-conductive emitter tube 14 designs described herein. These designs can be manufactured at a relatively low cost due to the low cost and simplicity of the dual emitter tubes 14 and the potential use of the inner tube $\mathbf{14}_i$ as a vacuum port. These designs can provide a stable support for the electron emitter 18, thus increasing electron emitter 18, and x-ray tube, lifetime. These designs can be helpful if the electron emitter 18 is to be disposed close to the anode 12 because the dual tubes 14 can provide a stronger support than posts over this extended distance. The emitter tubes 14, the cathode 13, and the electron emitter 18 can all be pre-assembled, then conveniently connected to the enclosure 11, thus allowing precise and repeatable placement of the electron emitter 18 in the x-ray tube during manufacturing, thus improving consistency of x-ray output between different units of a single x-ray tube model.

Method

Figure 7:
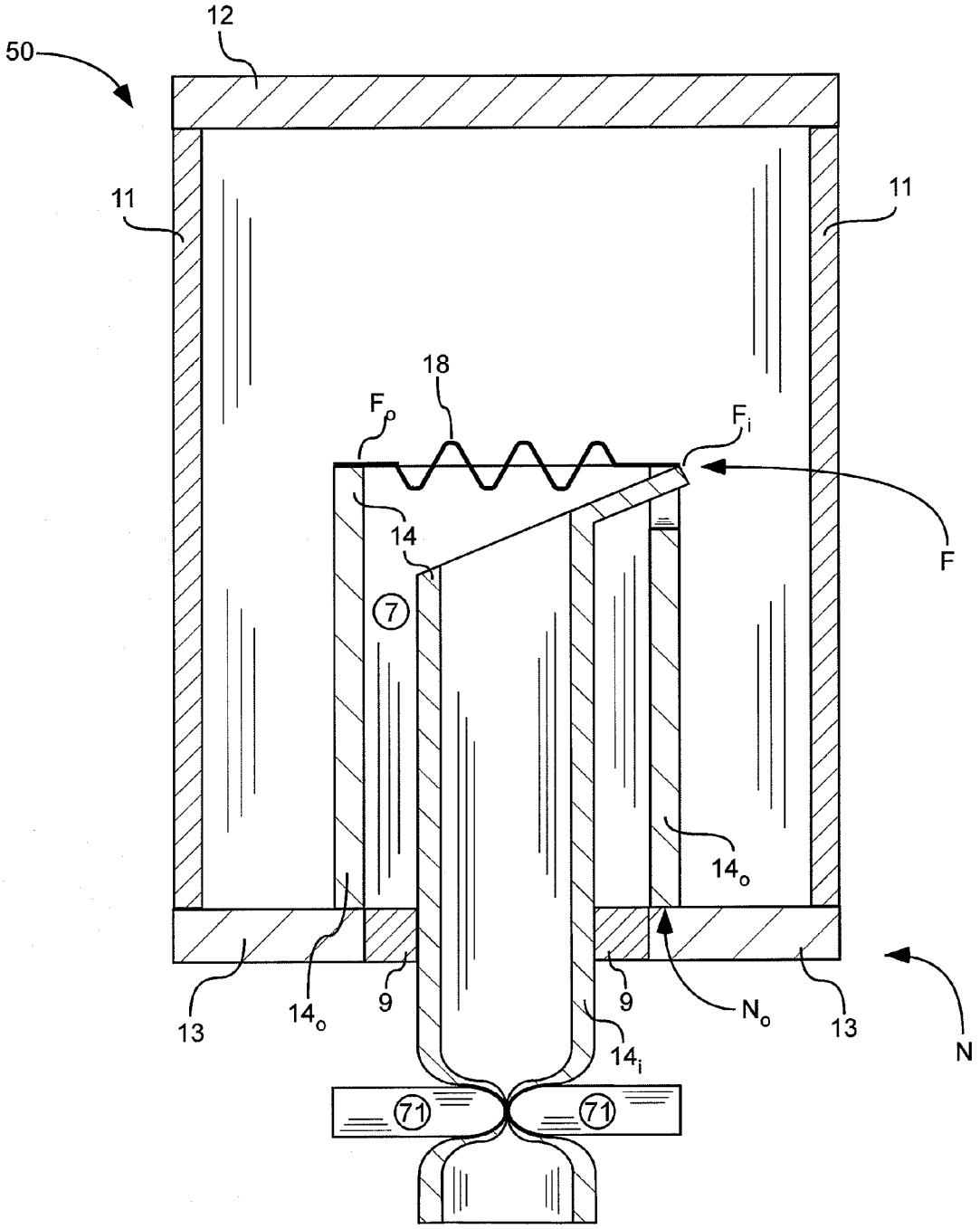
FIG. 7 is a schematic, longitudinal, cross-sectional side view of an x-ray tube with the inner tube being pinched shut, in accordance with an embodiment of the present invention.

A method, of evacuating and sealing an x-ray tube, can comprise some or all of the following steps, which can be performed in the order specified:

1. providing the x-ray tube 50 with (see FIG. 5):
   i. a cathode 13 and an anode 12 at opposite ends of an electrically insulative enclosure 11;
   ii. dual, electrically-conductive emitter tubes 14 extending from the cathode 13 towards the anode 12, and comprising an inner tube $\mathbf{14}_i$ disposed at least partially within an outer tube $\mathbf{14}_o$;
   iii. the inner tube $\mathbf{14}_i$ and the outer tube $\mathbf{14}_o$ each having opposite ends comprising a near end N disposed adjacent to, associated with, or attached to the cathode 13 and a far end F disposed closer to the anode 12;
   iv. an electron emitter 18 coupled between the far end $F_i$ of the inner tube $\mathbf{14}_i$ and the far end $F_o$ of the outer tube $\mathbf{14}_o$;
   v. the inner tube $\mathbf{14}_i$ and the outer tube $\mathbf{14}_o$ being electrically isolated from one another except for the electron emitter 18;
   vi. the inner tube $\mathbf{14}_i$ being open with the near end $N_i$ of the inner tube $\mathbf{14}_i$ extending outside the enclosure 11 beyond the cathode 13; and
   vii. the enclosure 11 sealed off except for the open inner tube $\mathbf{14}_i$;
2. substantially evacuating the x-ray tube 50 by drawing a vacuum on the enclosure 11 through the open inner tube 14, (see FIG. 6); and
3. sealing off the substantially evacuated x-ray tube 50 by pinching shut the near end $N_i$ of the inner tube $\mathbf{14}_i$ (see FIG. 7).

Sealing the x-ray tube 50 can be done by pinching the near end $N_i$ of the inner tube $\mathbf{14}_i$ with a hydraulic tool operated at high pressure, such as greater than 500 psi, while the inner tube $\mathbf{14}_i$ is still connected to a vacuum.

What is claimed is:

1. An x-ray tube, comprising:
   a. an evacuated, electrically-insulative enclosure with a cathode and an anode at opposite ends;
   b. dual, concentric, electrically-conductive emitter tubes extending from the cathode towards the anode, and comprising an inner tube and an outer tube;
   c. each of the inner and outer tubes having opposite ends comprising a far end disposed closer to the anode and an opposite near end associated with the cathode;
   d. a first gap between the far end of the outer tube and the anode and a second gap between the far end of the inner tube and the anode;
   e. an electron emitter:
      i. electrically-coupled between the far end of the inner tube and the far end of the outer tube;
      ii. substantially centered across the far end of the outer tube; and
      iii. having a center that is substantially aligned with a longitudinal axis of the enclosure;
   f. the inner and outer tubes being electrically isolated from one another except for the electron emitter;
   g. a length of the inner tube being greater than a length of the outer tube;
   h. the near end of the inner tube extending outside the enclosure; and
   i. the near end of the inner tube being a pinched-shut end.

2. The x-ray tube of claim 1, wherein the first gap is smaller than a length of the outer tube.

3. The x-ray tube of claim 1, wherein the first gap is between 4% and 25% of a length of the outer tube.

4. The x-ray tube of claim 1, further comprising an annular hollow between the far end of the outer tube and the enclosure.

5. The x-ray tube of claim 1, further comprising a power supply including a first cathode electrical connection that is electrically coupled to the near end of the outer tube by a helical spring.

6. An x-ray tube, comprising:
   a. an evacuated, electrically-insulative enclosure with a cathode and an anode at opposite ends;
   b. dual, electrically-conductive emitter tubes:
      a. extending from the cathode towards the anode;
      b. comprising an inner tube disposed at least partially inside of an outer tube; and c. each of the inner and outer tubes having opposite ends comprising a far end disposed closer to the anode and an opposite near end associated with the cathode;

c. a first gap between the far end of the outer tube and the anode and a second gap between the far end of the inner tube and the anode; and d. an electron emitter coupled between the far end of the inner tube and the far end of the outer tube, the inner and outer tubes being electrically isolated from one another except for the electron emitter.

7. The x-ray tube of claim 6, wherein the far end of the inner tube includes a radial projection extending radially outwardly from the inner tube towards the outer tube.

8. The x-ray tube of claim 7, wherein the radial projection extends towards a groove in the far end of the outer tube.

9. The x-ray tube of claim 8, wherein the far end of the outer tube substantially surrounds a circumference of the far end of the inner tube with the exception of the groove.

10. The x-ray tube of claim 6, wherein the electron emitter is substantially centered across the far end of the outer tube.

11. The x-ray tube of claim 6, wherein:

a. a length of the inner tube is greater than a length of the outer tube;

b. the near end of the inner tube extends outside the enclosure; and c. the near end of the inner tube is a pinched-shut end.

12. The x-ray tube of claim 11, wherein the pinched-shut end of the inner tube defines an electrical contact configured to be electrically coupled to a power supply.

13. The x-ray tube of claim 6, further comprising an annular hollow between the far end of the outer tube and the enclosure.

14. The x-ray tube of claim 6, further comprising a power supply including a first cathode electrical connection that is electrically coupled to the near end of the outer tube by a helical spring.

15. The x-ray tube and power supply of claim 14, wherein the helical spring is substantially enclosed within an electrically-conductive cup that is capped off with the cathode.

16. The x-ray tube of claim 6, wherein the first gap is smaller than a length of the outer tube.

17. The x-ray tube of claim 6, wherein the electron emitter is disposed between 0.5 millimeters and 8 millimeters from the anode.

18. The x-ray tube of claim 6, wherein the outer tube comprises titanium.

19. The x-ray tube of claim 6, wherein the inner tube comprises copper, nickel, or combinations thereof.

20. A method of evacuating and sealing an x-ray tube, the method comprising:

a. providing the x-ray tube with:

i. a cathode and an anode at opposite ends of an electrically-insulative enclosure;

ii. dual, electrically-conductive emitter tubes extending from the cathode towards the anode, and comprising an inner tube disposed at least partially within an outer tube;

iii. the inner tube and the outer tube each having opposite ends comprising a near end associated with the cathode and a far end disposed closer to the anode;

iv. an electron emitter coupled between the far end of the inner tube and the far end of the outer tube;

v. the inner and the outer tube being electrically isolated from one another except for the electron emitter;

vi. the inner tube being open with the near end of the inner tube extending outside the enclosure beyond the cathode; and vii. the enclosure sealed off except for the open inner tube;

b. substantially evacuating the x-ray tube by drawing a vacuum on the enclosure through the open inner tube; and c. sealing off the substantially evacuated x-ray tube by pinching shut the near end of the inner tube.

* * * * *